US005706727A

United States Patent [19]

Etter et al.

[11] Patent Number: 5,706,727

[45] Date of Patent: Jan. 13, 1998

[54] POSTAGE METER WITH IMPROVED PAPER PATH

[75] Inventors: Stefan Etter, Brenzikofen; Christian Moy, Grossaffoltern; Christian Gillieron, Fraubrunnen; Philippe Chollet, Corcelles; Kurt Nast, Bern, all of Switzerland

[73] Assignee: Ascom Hasler Mailing Systems AG, Switzerland

[21] Appl. No.: 403,461

[22] Filed: Mar. 14, 1995

[51] Int. Cl.[6] ..... B41J 13/24

[52] U.S. Cl. ..... 101/233; 400/703; 101/91

[58] Field of Search ..... 101/91, 232, 233, 101/234, 235; 400/703, 708, 711

[56] References Cited

U.S. PATENT DOCUMENTS

| | | | |
|---|---|---|---|
| 4,639,581 | 1/1987 | Berger et al. | 235/101 |
| 4,730,821 | 3/1988 | Flückiger | 270/58 |
| 4,746,234 | 5/1988 | Harry | 101/91 |
| 4,807,139 | 2/1989 | Liechti | 364/464.02 |
| 4,881,461 | 11/1989 | Nobile | 101/235 |
| 4,882,989 | 11/1989 | Nobile | 101/235 |
| 4,884,503 | 12/1989 | Nobile | 101/235 |
| 4,887,807 | 12/1989 | Berger et al. | 271/171 |
| 4,903,591 | 2/1990 | Nobile | 101/91 |
| 5,038,153 | 8/1991 | Liechti et al. | 346/140 |
| 5,060,821 | 10/1991 | Berger et al. | 221/190 |
| 5,082,384 | 1/1992 | Kakaguchi | 400/708 |
| 5,203,263 | 4/1993 | Berger et al. | 101/76 |
| 5,237,506 | 8/1993 | Horbal et al. | 364/464.02 |
| 5,276,844 | 1/1994 | Aebi et al. | 395/425 |
| 5,278,541 | 1/1994 | Wicht et al. | 340/636 |
| 5,301,116 | 4/1994 | Grünig | 364/464.02 |
| 5,339,100 | 8/1994 | Mistyurik | 101/91 |
| 5,340,965 | 8/1994 | Horbal et al. | 235/101 |
| 5,355,155 | 10/1994 | Mistyurik | 101/91 |
| 5,359,273 | 10/1994 | Flückiger | 318/794 |
| 5,363,760 | 11/1994 | Lindenmueller et al. | 101/91 |
| 5,389,863 | 2/1995 | Flückiger | 318/549 |
| 5,524,995 | 6/1996 | Brookner et al. | 400/708 |

FOREIGN PATENT DOCUMENTS

| | | |
|---|---|---|
| 0062376 | 10/1992 | European Pat. Off. . |
| 0526139 | 2/1993 | European Pat. Off. . |
| 0526140 | 2/1993 | European Pat. Off. . |
| WO89/11134 | 11/1989 | WIPO . |

*Primary Examiner*—David A. Wiecking

*Attorney, Agent, or Firm*—Oppedahl & Larson

[57] ABSTRACT

A postage meter has the print rotor and platen within a single secure housing, with a letter detection lever along the paper path downstream from the rotor. The letter detection lever is in a spring-loaded coupling relationship with the trigger that triggers franking. If a letter remains in the meter due to a paper jam, the detection lever continues to be actuated and the spring-loaded coupling keeps the trigger in the triggered position. The meter further comprises a platen carrier moving the platen toward and away from the rotor; when the rotor is in its home position a radial cam on the rotor and cam follower keep the carrier away from the rotor. When franking of a letter begins and the rotor begins to rotate, the rotor cam releases the cam follower, permitting the carrier to move up in spring-loaded relation toward the rotor. A letter stopper is in the paper path downstream from the rotor and helps to align the letter so that the postage imprint is optimally oriented on the letter. The trigger includes an enclosure containing a free-moving mass; the weight is constrained from radial and axial movement relative to the trigger pivot. The trigger is balanced in two axes in the plane in which it rotates, thus it has no net moment (or minimal net moment) about its pivot. The mass and the enclosure shape are selected to damp movement of the trigger as it returns to its home position after it is triggered.

60 Claims, 14 Drawing Sheets

POSTAGE METER WITH IMPROVED PAPER PATH

The invention relates generally to postage machines, and relates more particularly to an improved paper path for a postage machine.

BACKGROUND OF THE INVENTION

It is not easy to design a postage meter. The meter has to print postage, but in addition to that straightforward requirement there are imposed numerous other requirements. The meter must be sufficiently secure to satisfy the postal authorities on whose behalf postage value is to be printed. This requirement means that many portions of the meter, including the ascending and/or descending register and the print rotor, must be within a secure housing. The housing must be such that one seeking to tamper with the meter would either (1) be unable to gain access to parts of the meter permitting the unauthorized printing or (2) be able to do so only after leaving unmistakable signs of the unauthorized access. Despite the fact that the housing must be secure, it must nonetheless permit ready insertion of mail pieces to be franked, and ready access to the pieces which have been franked. Despite the fact that the housing must be secure, it must nonetheless permit ready removal of a jammed mail piece.

The designer must also balance incompatible requirements such as that the meter must not be too heavy nor too expensive. It must also be quite reliable, satisfying requirements imposed by postal authorities that it perform properly even after half a million or a million print cycles. And it must offer numerous features as required and expected by users. The meter must only rarely misprint postage on mail pieces, and it must print on labels as well as envelopes.

Uninterrupted efforts have proceeded by the manufacturers of postage meters for many decades, yet despite these decades of effort the meters have not had all the features that would be desired, have not had the manufacturing cost reduced as far as desired, and have not been as good as might be desired in avoiding inadvertent duplicate printings of postage in the event of paper jams.

SUMMARY OF THE INVENTION

A postage meter has the print rotor and platen within a single secure housing, with a letter detection lever along the paper path downstream from the rotor. The letter detection lever is in a spring-loaded coupling relationship with the trigger that triggers franking. If a letter remains in the meter due to a paper jam, the detection lever continues to be actuated and the spring-loaded coupling keeps the trigger in the triggered position. This reduces the incidence of unintended duplicate frankings in the event of a paper jam. The meter further comprises a platen carrier moving the platen toward and away from the rotor; when the rotor is in its home position a radial cam on the rotor and cam follower keep the carrier away from the rotor. When franking of a letter begins and the rotor begins to rotate, the rotor cam releases the cam follower, permitting the carrier to move up in spring-loaded relation toward the rotor. In this way the platen grips the letter and the letter moves along the paper path. A letter stopper is in the paper path downstream of the rotor when the rotor is in its home position; when franking begins and the carrier moves toward the rotor, the stopper is withdrawn from the paper path. The stopper helps to align the letter so that the postage imprint is optimally oriented on the letter. The trigger includes an enclosure containing a free-moving mass; the weight is constrained from radial and axial movement relative to the trigger pivot. The trigger is balanced in two axes in the plane in which it rotates, thus it has no (or minimal) net moment about its pivot. The mass and the enclosure shape are selected to damp movement of the trigger after it is triggered and as it returns from the triggered position back to the home position. The portion of the trigger lying within the paper path is substantially within or slightly downstream of the plane containing the rotor and platen axes.

As a result the paper handling of the meter is greatly improved. Jams are less frequent, feeding of mail pieces is more reliable, printing of postage squarely on the mail piece is enhanced, and in the event of a jam the likelihood is reduced of inadvertent duplicate printing of postage.

DESCRIPTION OF THE DRAWING

The invention will be described with respect to a drawing in several figures, of which.

Where possible, like reference numerals have been used to identify like elements.

DETAILED DESCRIPTION

Figure 20:
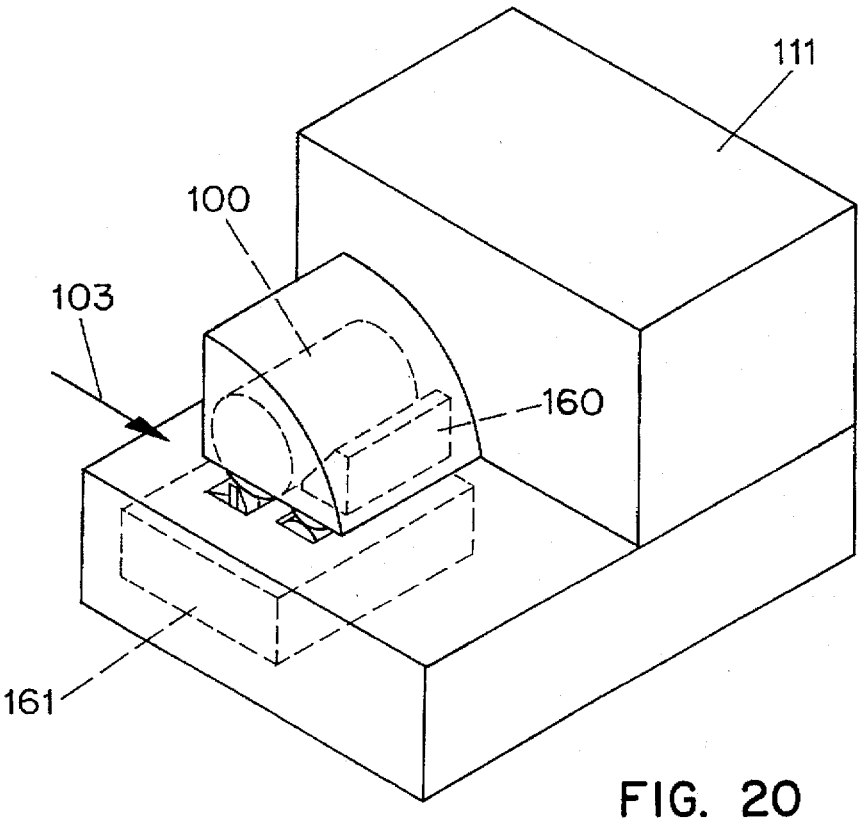
FIG. 20 is a perspective view of an exemplary meter.

Turning first to FIG. 20, what may be seen is the postage meter according to the invention. The meter is contained generally within a secure housing 111. A mail piece is inserted into the meter along a paper path 103. The mail piece (which may be an envelope or label) passes between a print rotor 100 (shown in phantom in FIG. 20) and a platen, and emerges from the meter, to the right in FIG. 20. The view from the entry direction (from the left in FIG. 20) is shown in FIG. 4. The view from the exit direction (from the right in FIG. 20) is shown in FIG. 15. The side view (from the front in FIG. 20) is shown in a large view in FIG. 16 and in a detailed view in FIG. 3. A lower assembly (shown in phantom as 161 in FIG. 20) is shown in greater detail in FIGS. 12, 13, 14 and 19. An upper assembly (shown in phantom as 160 in FIG. 20) is shown in greater detail in FIGS. 17 and 18.

Figure 1:
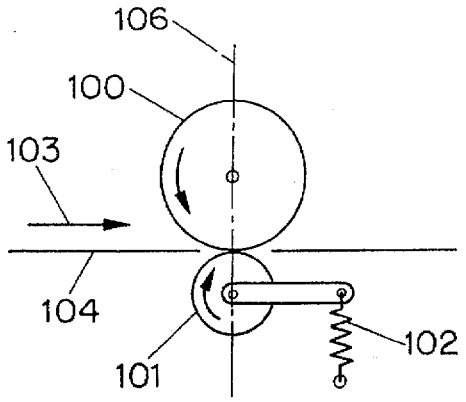
FIG. 1 PRIOR ART
FIG. 1 shows a prior art paper path in side view.

FIG. 1 shows a prior art paper path in side view. Rotor 100 and resilient platen 101 may be seen. Spring 102 keeps platen 101 urged upwards against rotor 100 continuously. As will be appreciated by those skilled in the art, platen 101 will from time to time move more or less downwards in FIG. 1 to accommodate mail pieces of varying thickness.

Those skilled in the art will also appreciate that the trigger (omitted for clarity in FIG. 1) by which the meter senses arrival of a mail piece must necessarily be some nonzero distance to the left of the plane 106 which contains the axes of rotation of the rotor 100 and platen 101. This is so because the mail piece becomes wedged into the crack between the rotor and platen, and can move no further until franking begins, that is, until the motor (omitted for clarity in FIG. 1) is actuated by the trigger. From this it follows that the trigger must be at least slightly to the left of the plane 106. It is all too easy for the human operator to hesitate in inserting a mail piece, so that the trigger is actuated and yet the mail piece does not quite become captive between the rotor 100 and platen 101; the result is wasted postage value. While this unhappy result may be minimized by moving the trigger rightwards in FIG. 1, the danger is that the trigger point will be too far to the right (i.e. at or beyond the plane 106 so that franking will not be possible since the mail piece will not actuate the trigger.

Another difficulty can arise with the arrangement of FIG. 1 in that if a mail piece becomes jammed in the meter, for example so that it is trapped between the rotor 100 and platen 101 and yet is no longer in contact with the trigger, there is the danger that efforts to extricate the mail piece may result in actuating the trigger once again, using up postage value without printing the postage value in a useful way on any mail piece.

Figure 2:
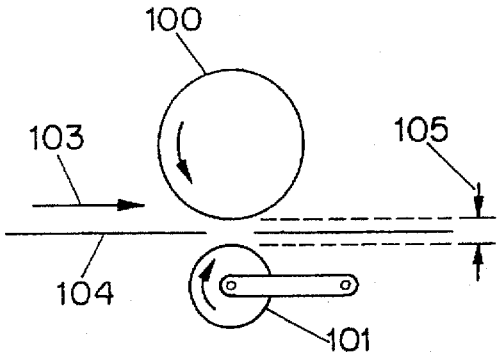
FIG. 2 shows the paper path according to the invention in side view.

FIG. 2 shows the paper path according to the invention in side view. In this simplified diagram the paper path 103 may be seen. Until franking begins there is a separation 105 between the rotor 100 and platen 101. A cam (omitted for clarity in FIG. 2) on the rotor 100 displaces a cam follower (also omitted for clarity in FIG. 2) which moves the platen 101 down to the position shown. Separation 105 is determined by the range of mail piece thicknesses expected, and may be in the range of 3 to 8 millimeters, or more preferably in the range of 5 to 7 millimeters, or most preferably about 6.35 millimeters.

Figure 3:
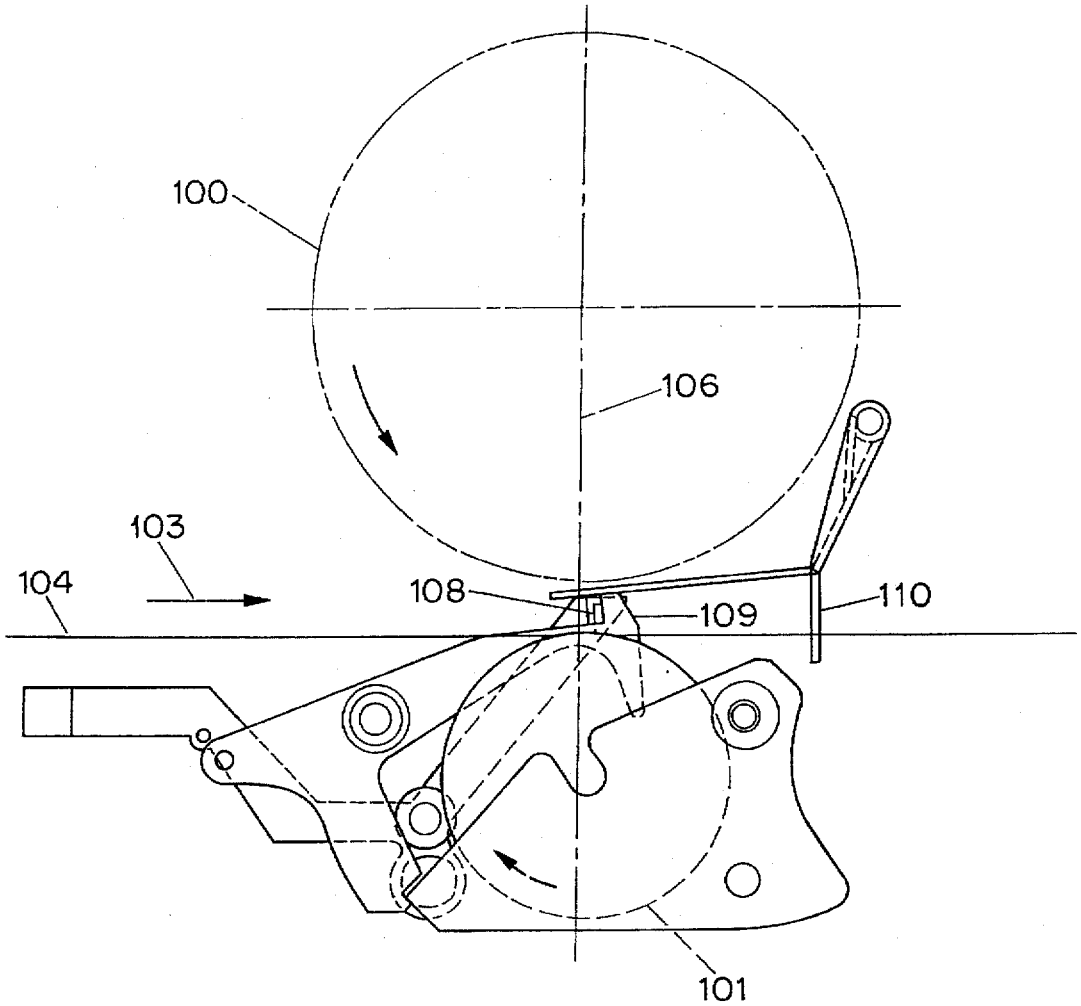
FIG. 3 shows the paper path of FIG. 2 in greater detail.
Figure 4:
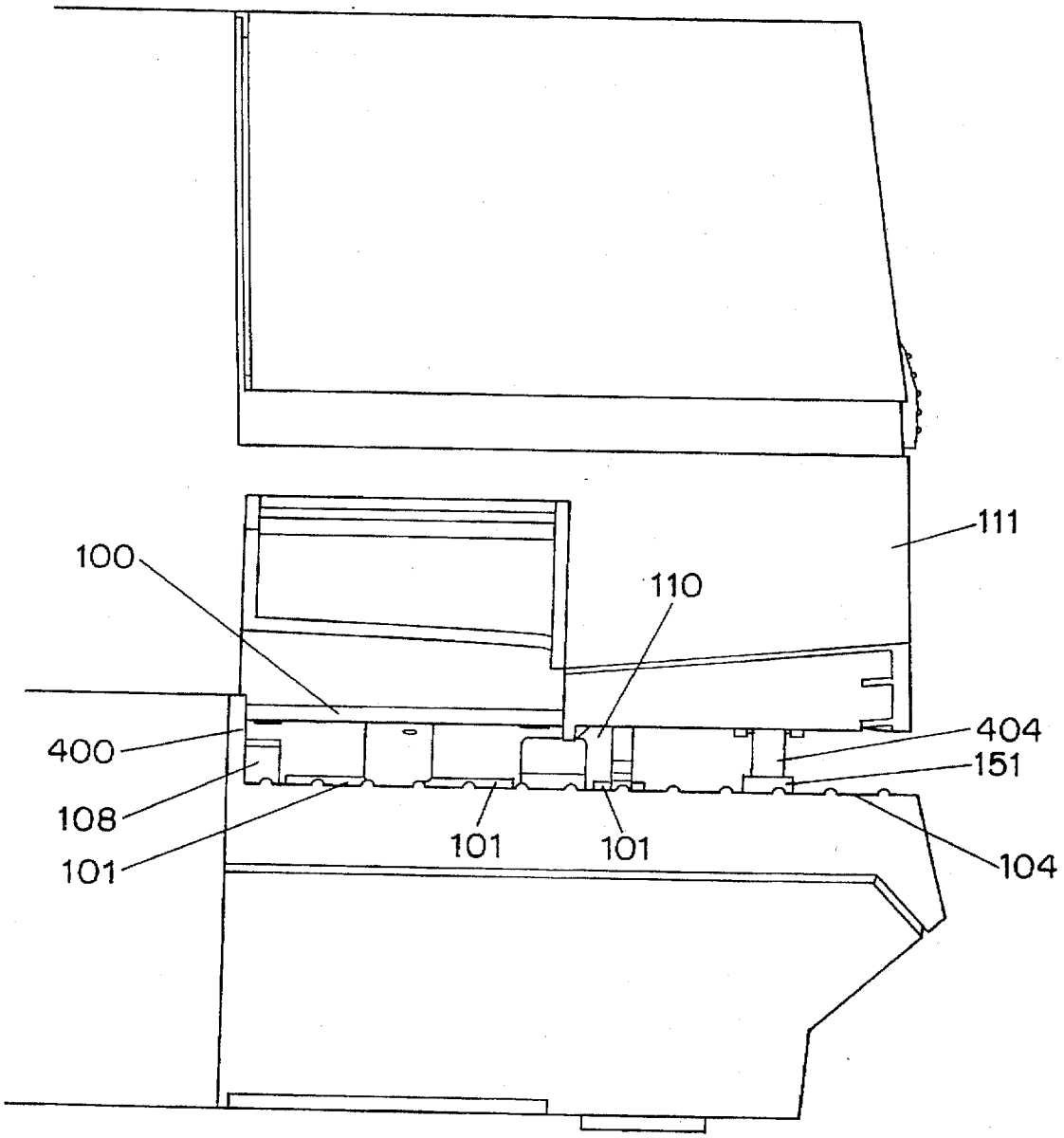
FIG. 4 shows the paper path according to the invention from the direction of insertion of a mail piece including a trigger, a platen, a print rotor and a letter stopper.

FIG. 3 shows the paper path of FIG. 2 in greater detail. As may be seen, the first thing a mail piece strikes when being inserted along the mail path 103 (parallel to surface 104) is a portion 108 of the trigger. The trigger is pivoted as will be described in some detail below, and moves sufficiently to permit the mail piece to strike a portion 109 of a letter stopper. The force which must be applied at the mail piece to deflect the trigger this far is about 0.15 Newtons. The deflection distance from the point at which the mail piece strikes the trigger to the point at which the mail piece strikes the stopper is about 2.1 millimeters. Also visible in FIG. 3 is a letter detection lever 110 about which more will be said later. This lever reduces the unwanted printing of postage in extricating jammed mail pieces.

Figure 16:
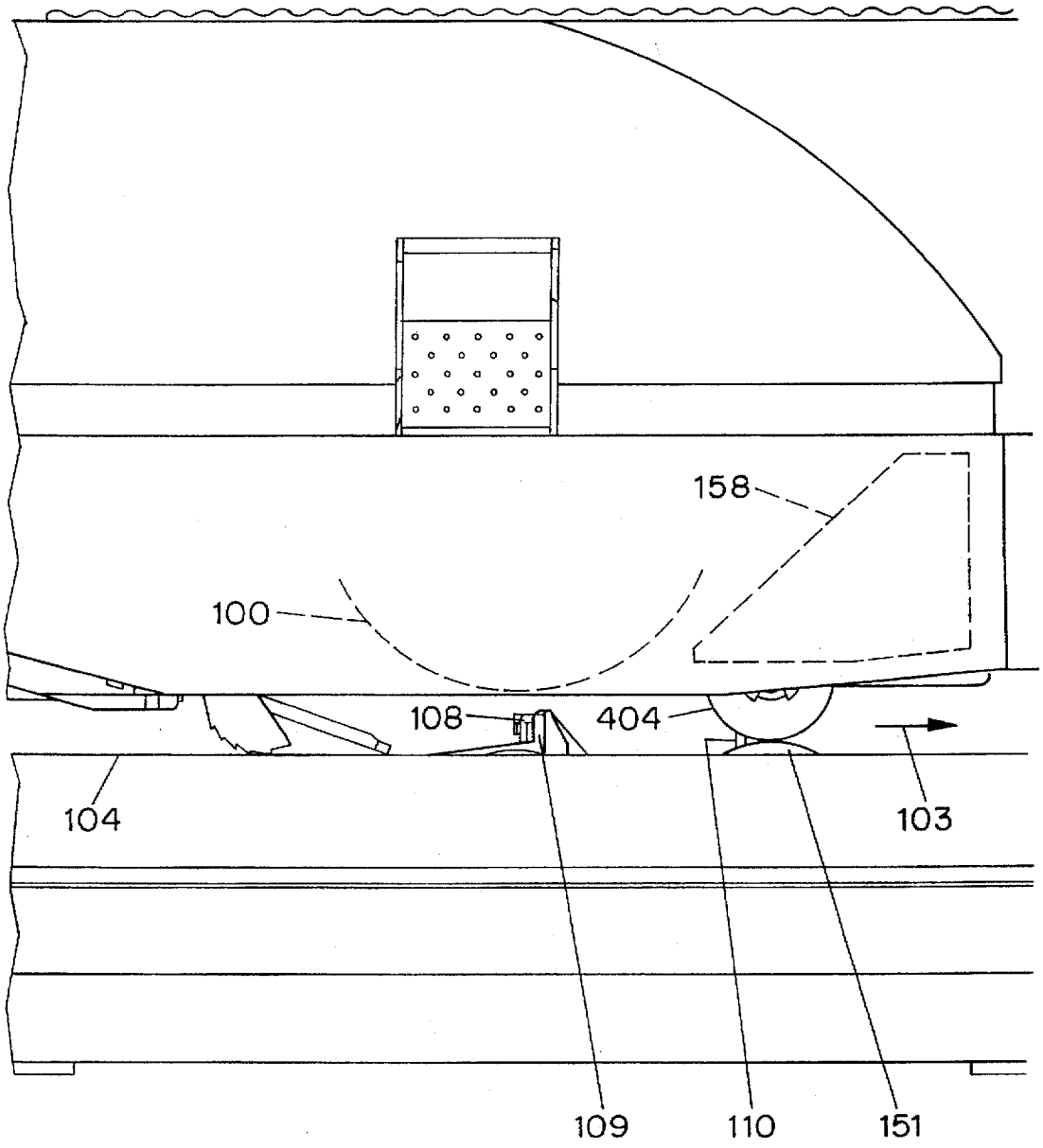
FIG. 16 shows the paper path in an expanded side view, including a subchassis.

FIG. 16 shows the paper path side view of FIG. 3 but on a larger scale. Trigger portion 108 and stopper portion 109 are visible. Downstream in the paper path are ejection roller 151 and ejection idler 404. Also visible is part of detection lever 110. Detector 110 and idler 404 are held by subchassis 158, shown in phantom in FIG. 16. A preferable sequence may be seen as well: the trigger portion 108 is downstream of the plane 106 containing the rotor and platen axes; the stopper portion 109 is downstream of the trigger portion 108; and the detection lever 110 is downstream of the stopper portion 109.

FIG. 4 shows the paper path according to the invention from the direction of insertion of a mail piece. A small portion of the bottom of rotor 100 may be seen. Also visible is guide wall 400 formed as part of the secure housing 111, as well as horizontal surface 104. Platen 101, which is in two coaxial portions, may also be seen. Between the platen 101 and the wall 400 is a portion 108 of the trigger. Between the two portions of the platen 101 is a portion 109 of the letter stopper. Behind the items just described it is possible to see ejection roller 151, ejection idler 404, and letter detector lever 110.

Figure 5:
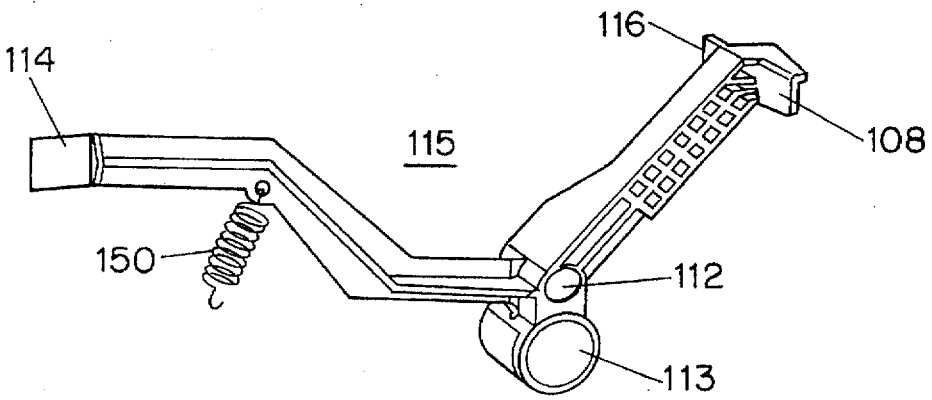
FIGS. 5, 6, and 7 show the trigger of FIG. 4 in perspective, side, and end views respectively.
Figure 6:
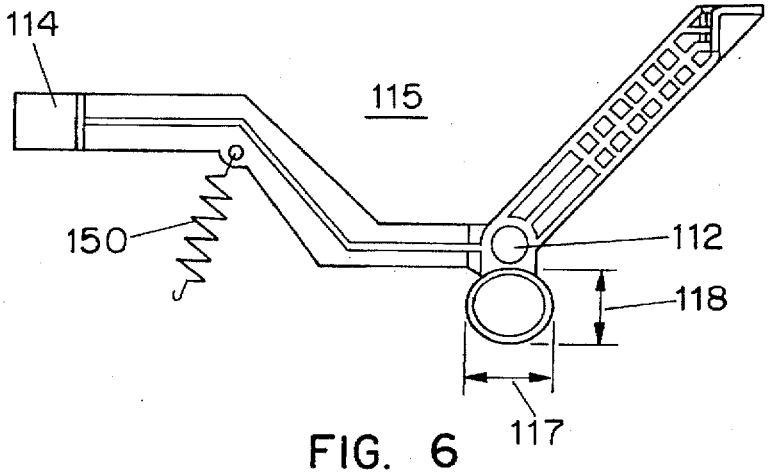
Figure 7:
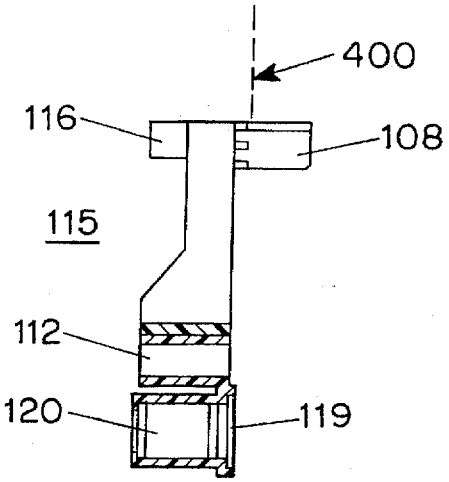

FIGS. 5, 6, and 7 show the trigger 115 of FIG. 4 in perspective, side, and end views respectively. The trigger is rotatable about pivot 112. Pivot 112 is closer to portion 108 than it is to blade portion 114, and this yields the desirable result that a small deflection at portion 108 is magnified at blade end 114. Blade end lies between a light-emitting diode 453 (see FIG. 21) and a phototransistor 454 (see FIG. 21), the output of which is made available to a microprocessor which controls the postage meter. When the trigger is in the home position (no mail piece in the meter) the blade blocks the light. When a mail piece enters the paper path, the blade is lifted up from the sensor and the phototransistor is turned on; this provides a logical signal to the microprocessor of the meter. Return spring 150 urges the trigger counterclockwise, so that portion 108 tends to be in the paper path. Within the enclosure is a free-moving steel bolt 120, about 8 mm in diameter. The enclosure opening is shaped to permit about 8.4 mm horizontally (dimension 117), or about 0.4 mm of clearance horizontally. The opening is about 8 mm vertically, so there is only a very slight clearance vertically. The opening and mass are selected to effectively damp movement of the trigger when it is returning to its home position after actuation by a mail piece. A lid 119 seals the bolt within the enclosure. Because the enclosure is sealed, the performance of the damper is essentially unchanged with time. This is in contrast to other approaches which might be taken such as a dashpot or a frictional mechanism that is open to the atmosphere. The system is able to effectively damp the quick movement of the trigger. This is preferable to prior-art approaches which call for a dashpot, since a dashpot generally slows things down. It is also preferable to prior-art approaches that simply use friction, since such approaches rely on close tolerances that change their behavior over time.

With reference to FIGS. 4 and 7, it should be appreciated that wall 400 permits only a small portion 108 of the trigger to be visible from outside the secure housing 111. Feature 116 is also visible in FIGS. 5 and 7, about which more will be said later regarding the detection lever.

Figure 8:
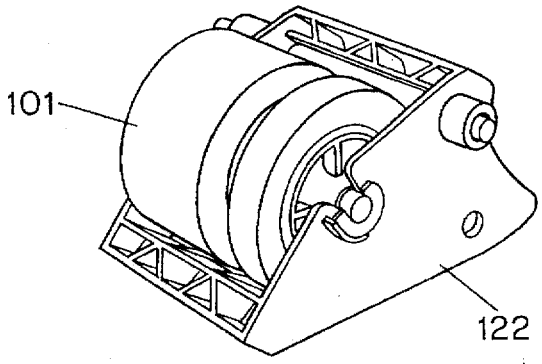
FIGS. 8 and 9 show the platen of FIG. 4 in two different perspective views together with a carrier.
Figure 9:
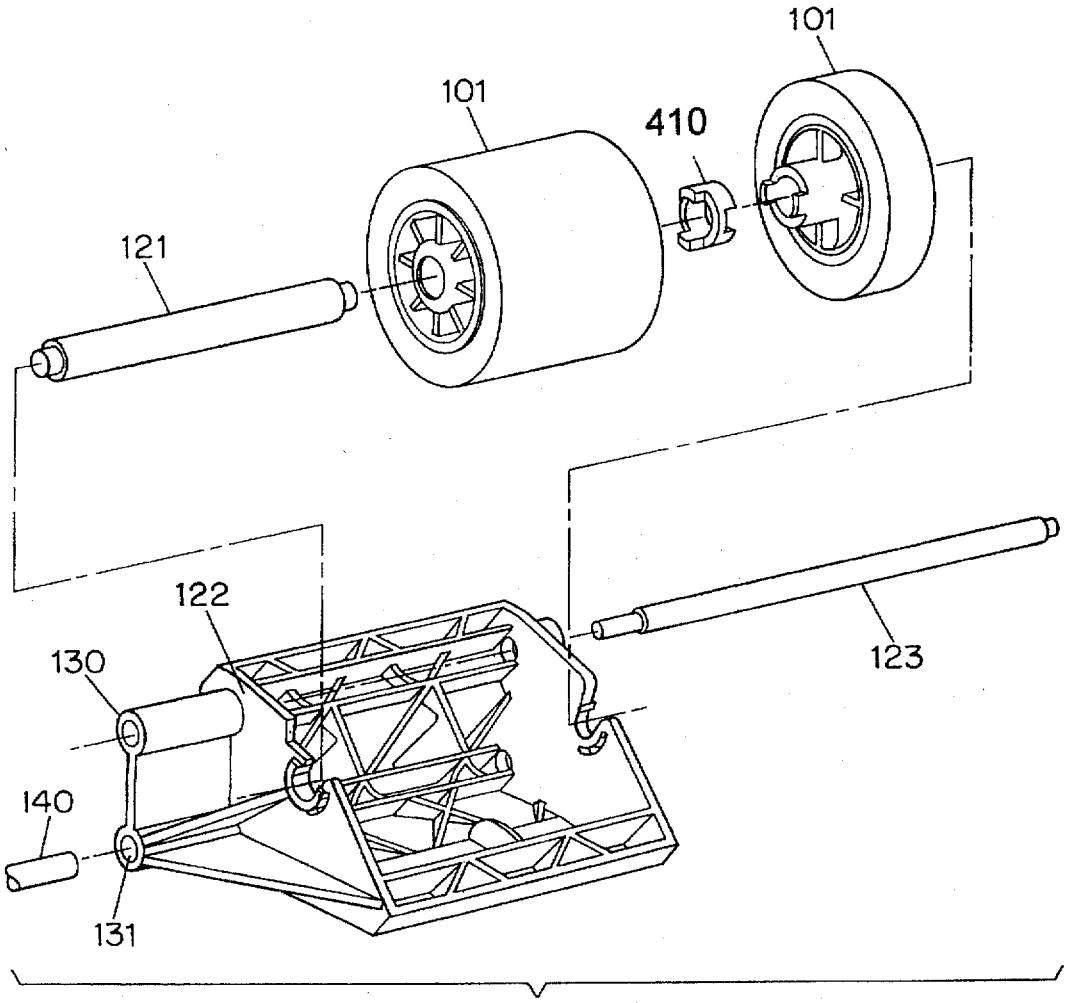

FIGS. 8 and 9 show the platen of FIG. 4 in two different perspective views together with a carrier 122. Carrier 122 is preferably made of plastic. The carrier pivots by means of feature 130 on shaft 123 which is fixed to the meter chassis. Shaft 140, a portion of which is visible in FIG. 9, is urged by a spring (not shown in FIG. 9) so that the platen 101 tends to move upwards in FIGS. 8 and 9, namely closer to the print rotor (not shown in FIG. 9). The platen 101 is in two portions which are desirably fixed together rotationally by key 410.

The platen 101 rotates on shaft 121 which is snap-fit into features on the carrier 122.

Figure 10A:
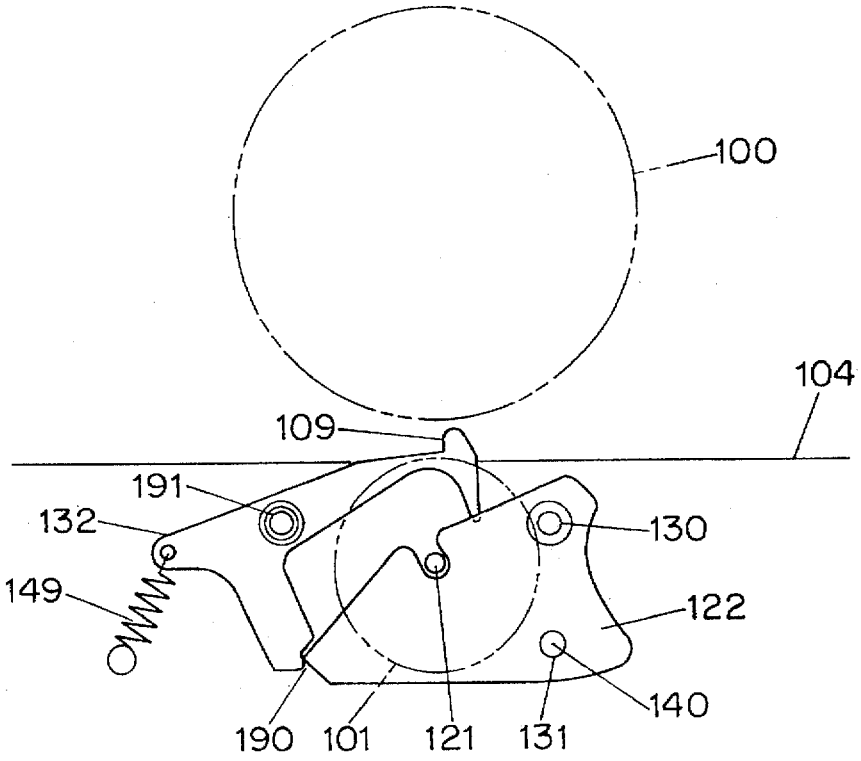
FIGS. 10A, 10B, and 10C show the letter stopper of FIG. 4 and its mechanical linkage with the platen carrier of FIG. 8.
Figure 10B:
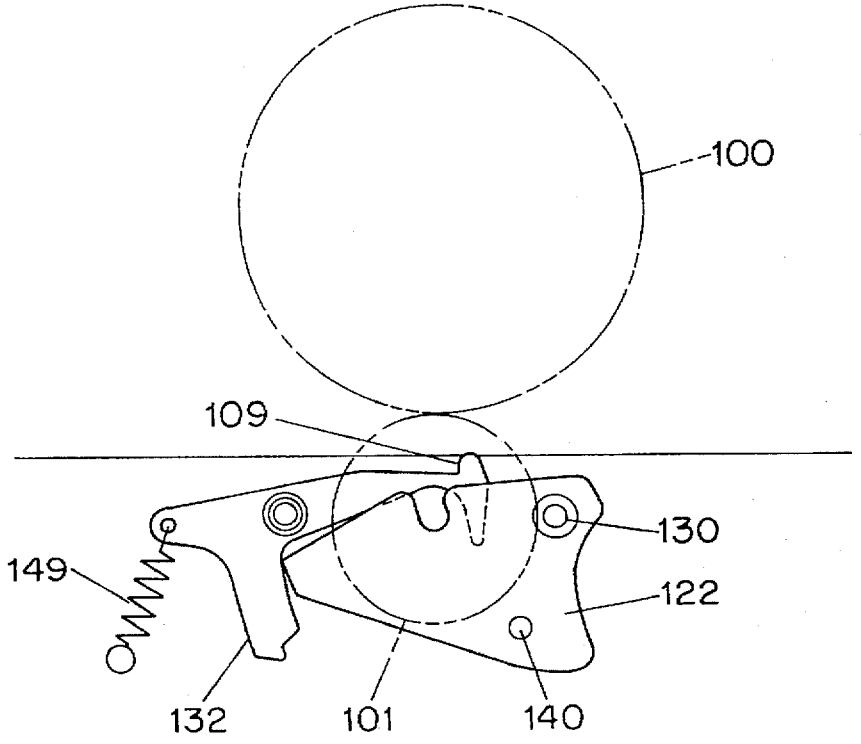
Figure 10C:
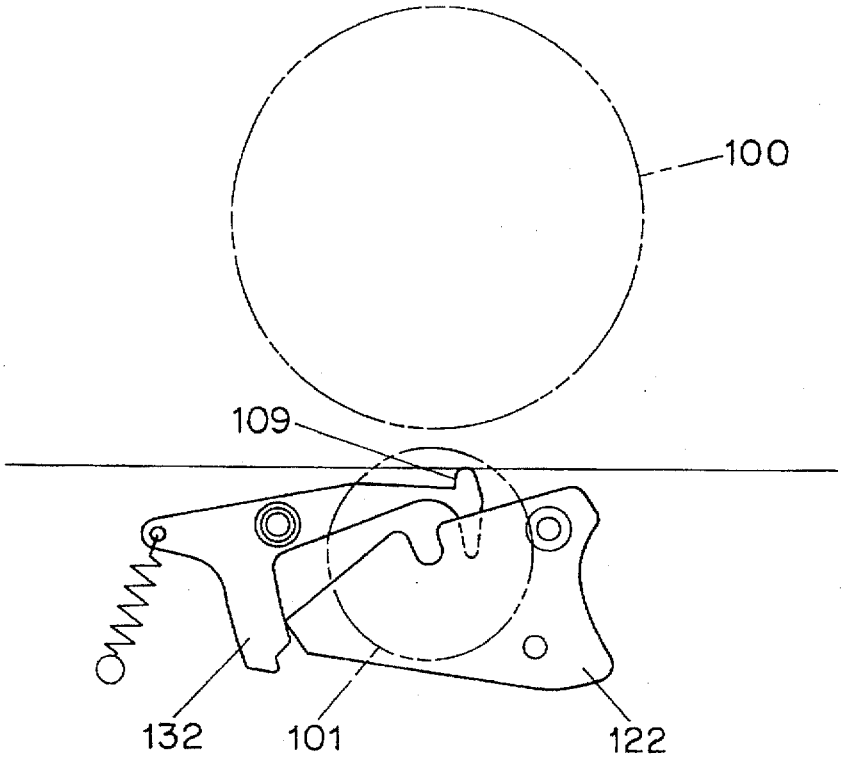

FIGS. 10A, 10B, and 10C show the letter stopper of FIG. 4 and its mechanical linkage with the platen carrier of FIG. 8. Recall that platen carrier 122 pivots on shaft 123, which is fixed to the meter chassis. The upward and downward movement of the carrier 122 is controlled by leftward and rightward movement of shaft 140 which is located in hole 131. Shaft 140 is urged leftwards in FIG. 10A by a spring, not shown in FIG. 10A, which results in the platen 101 being urged upwards in FIG. 10A toward the rotor 100. Two forces will from time to time oppose the upward motion of the platen. First, if there is a mail piece in the meter between the rotor and platen, this forces the platen downward since the rotor is held in journal bearings within the meter chassis and so does not move upwards or downwards. Second, a cam and cam follower arrangement, omitted for clarity in FIGS. 10A, 10B, and 10C, will at times move the shaft 140 rightwards in FIGS. 10A, 10B, and 10C. When the cam follower moves rightwards as in FIG. 10A, the space between the platen 101 and rotor 100 is typically about 7.7 millimeters.

What remains in FIGS. 10A, 10B, and 10C is to describe the linkage between the carrier 122 and the letter stopper 132. Letter stopper 132 has a portion 109 which is visible to the user (e.g. in FIG. 4), and the remainder of which is normally concealed from view below horizontal surface 104. The letter stopper 132 pivots about point 191. Spring 149 urges the letter stopper counterclockwise in FIG. 10A, so that the portion 109 tends to be within the paper path. When franking begins, however, as shown in FIG. 10B, the above-referenced cam and cam follower (discussed in detail below) release carrier 122, permitting it to rotate clockwise, that is, permitting the platen 101 to move upwards against the rotor 100. Those skilled in the art will appreciate that there is a point of engagement at 190 between the carrier 122 and the letter stopper 132. Upward movement of the carrier 122 results in a sliding point of contact that forces the letter stopper 132 to rotate clockwise. From the point of view of the paper path, there are two results—the portion 109 drops downward (below the horizontal surface 104) and does not impede movement along the paper path, and the platen 101 moves upwards toward the rotor 100, tending to grip the mail piece. In the absence of a mail piece, the nominal spacing is about 0.377 millimeters.

A full discussion of the design for the letter stopper requires consideration of FIG. 10C. In this figure, it is assumed that a mail piece lies between the rotor 100 and platen 101, thus forcing the platen 101 and its carrier 122 downward. It will be appreciated, however, that the shape of the letter stopper 132 is chosen so that the stopper remains down, out of the paper path. Only when the platen moves substantially downward (as in FIG. 10A) does the shape of lever 132 lead to its being released back to its counterclockwise spring-loaded position.

Figure 11A:
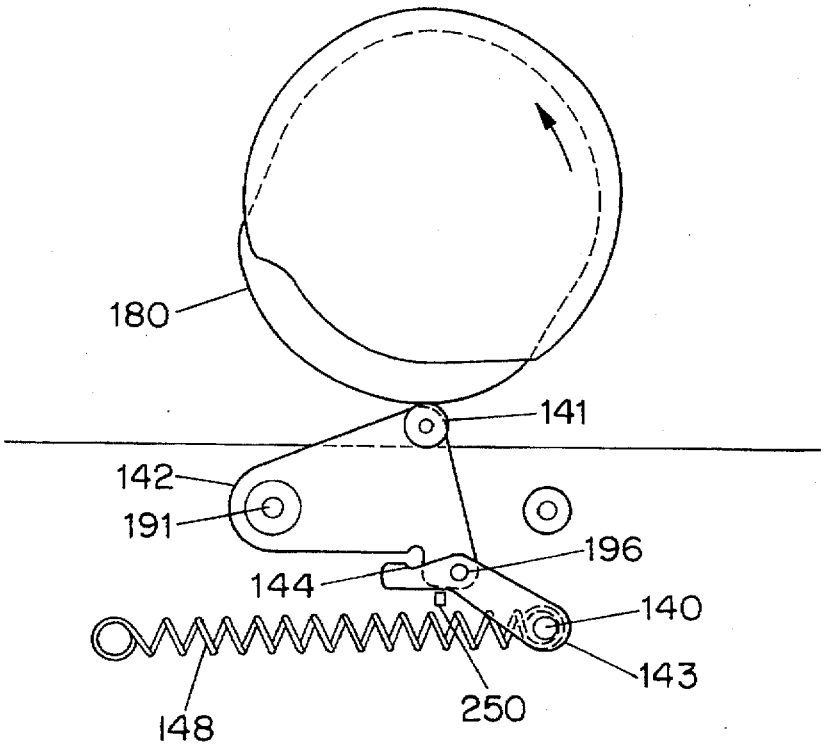
FIGS. 11A and 11B show a cam follower and knee link which move the platen carrier of FIG. 8 downwards.
Figure 11B:
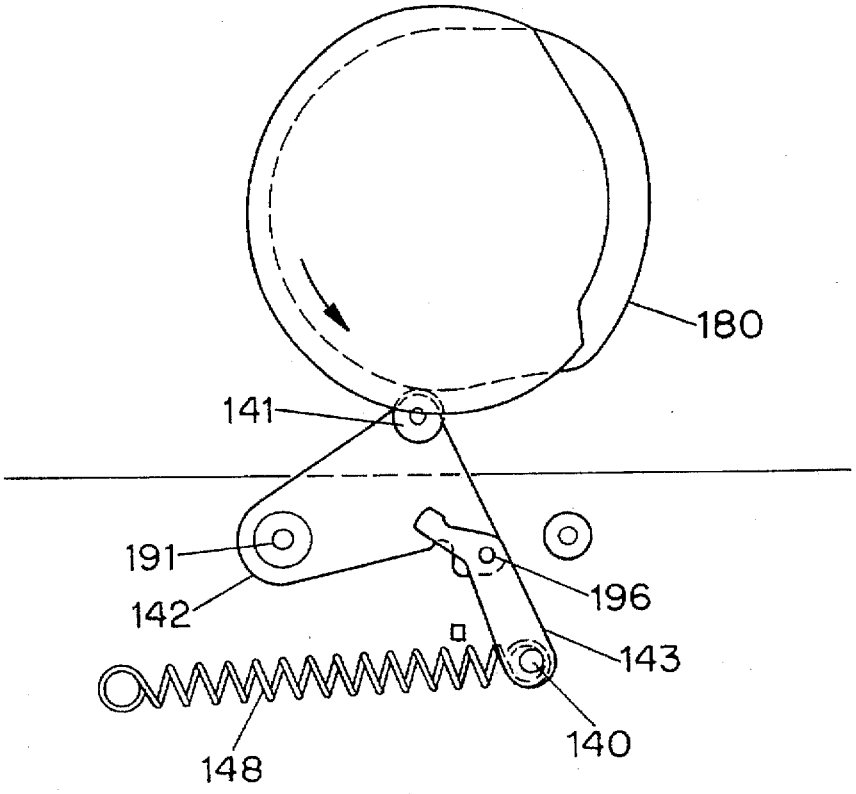

In connection with FIG. 10A the shaft 140 was discussed, which moves to the right or left to control movement of the platen carrier 122. Turning now to FIGS. 11A and 11B, a knee linkage will be described which tends to move the shaft 140 rightwards. The print rotor 100 has a radial cam with a bump 180. A cam follower 141 is in contact with the radial cam, and pivots on point 191. Bump 180 is positioned so that when the rotor is in its home position, which is the position of the rotor at rest between printing cycles, the bump engages the cam follower 141. This forces the cam follower downwards in FIG. 11A, which actuates a knee linkage with link 143, forcing shaft 140 to the right in FIG. 11A.

When franking begins as shown in FIG. 11B, the rotor rotates in the direction shown (counterclockwise) and the bump 180 no longer touches the cam follower 141. Because shaft 140 is urged leftwards by a spring 148, the result is that link 143 moves leftward and cam follower, pivoting on 191, rotates counterclockwise and upwards.

During franking the upward travel of cam follower 141 has three possible limits. The chief limit is that the platen 101 cannot move upwards any further than the point of contact with the rotor 100. Thus in normal franking the follower 141 does not rise all the way up to the point of touching the cam; it is held down by the platen having reached the rotor. Indeed as a mail piece of varying thickness passes along the mail path, the platen 122 rides up and down the lower surface of the mail piece, and in a corresponding way the follower 141 moves up and down, never reaching up to have contact with the cam.

A feature at 144 (FIG. 11A) is capable of limiting the upward travel of the cam follower 141. The feature is called into use only during assembly and disassembly of the meter, by inserting a rod-shaped spacer, when the rotor is not in place to push down the platen 122 or follower 141.

It might be thought that the cam follower 141 could, through inadvertence, be pushed too far down so that it would not come back up, that is, with point 196 below the line of points 191 and 140 (FIG. 11A). A feature 250 in the meter base provides a point below 196 to prevent such movement.

Figure 12:
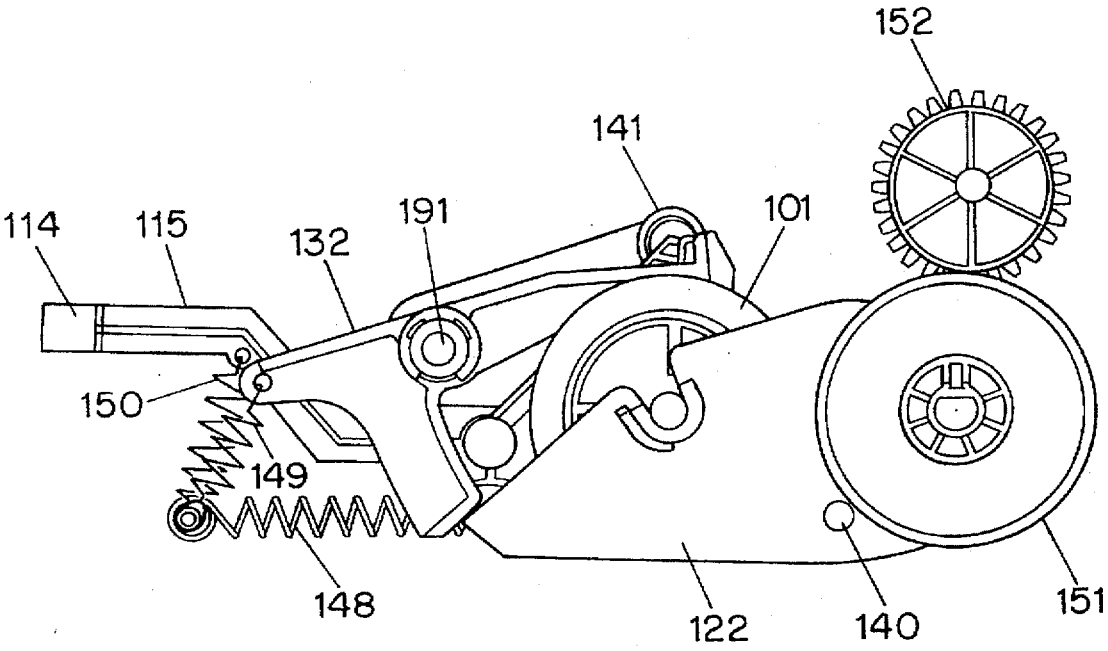
FIGS. 12, 13, and 14 show the assembly of the platen, carrier, and letter stopper in a side view, a perspective view, and a second perspective view, respectively.
Figure 13:
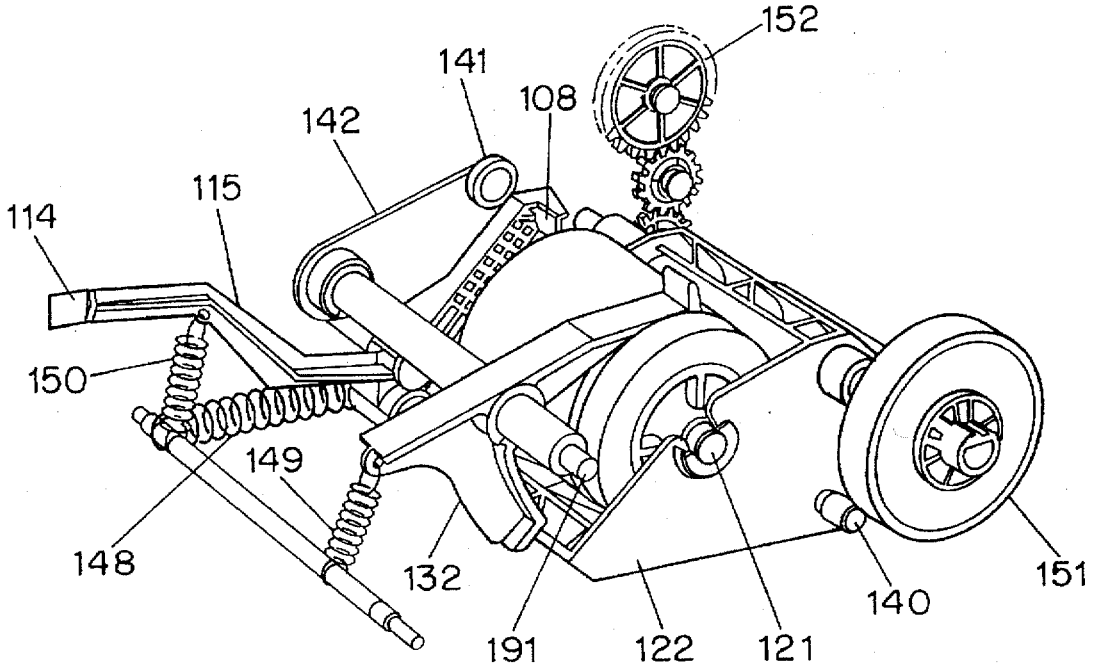
Figure 14:
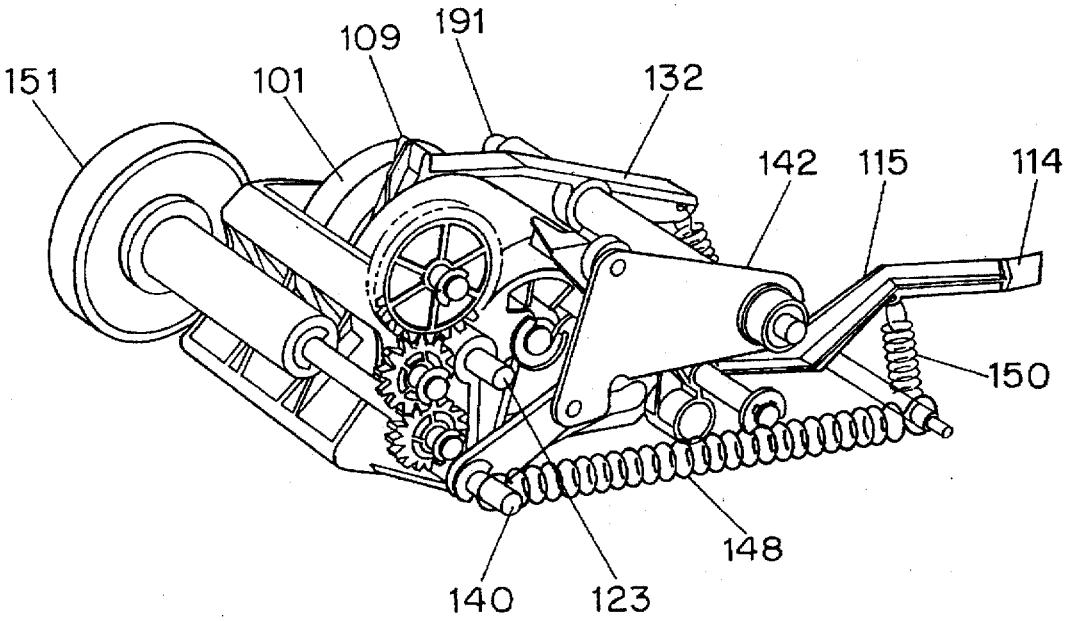
Figure 15:
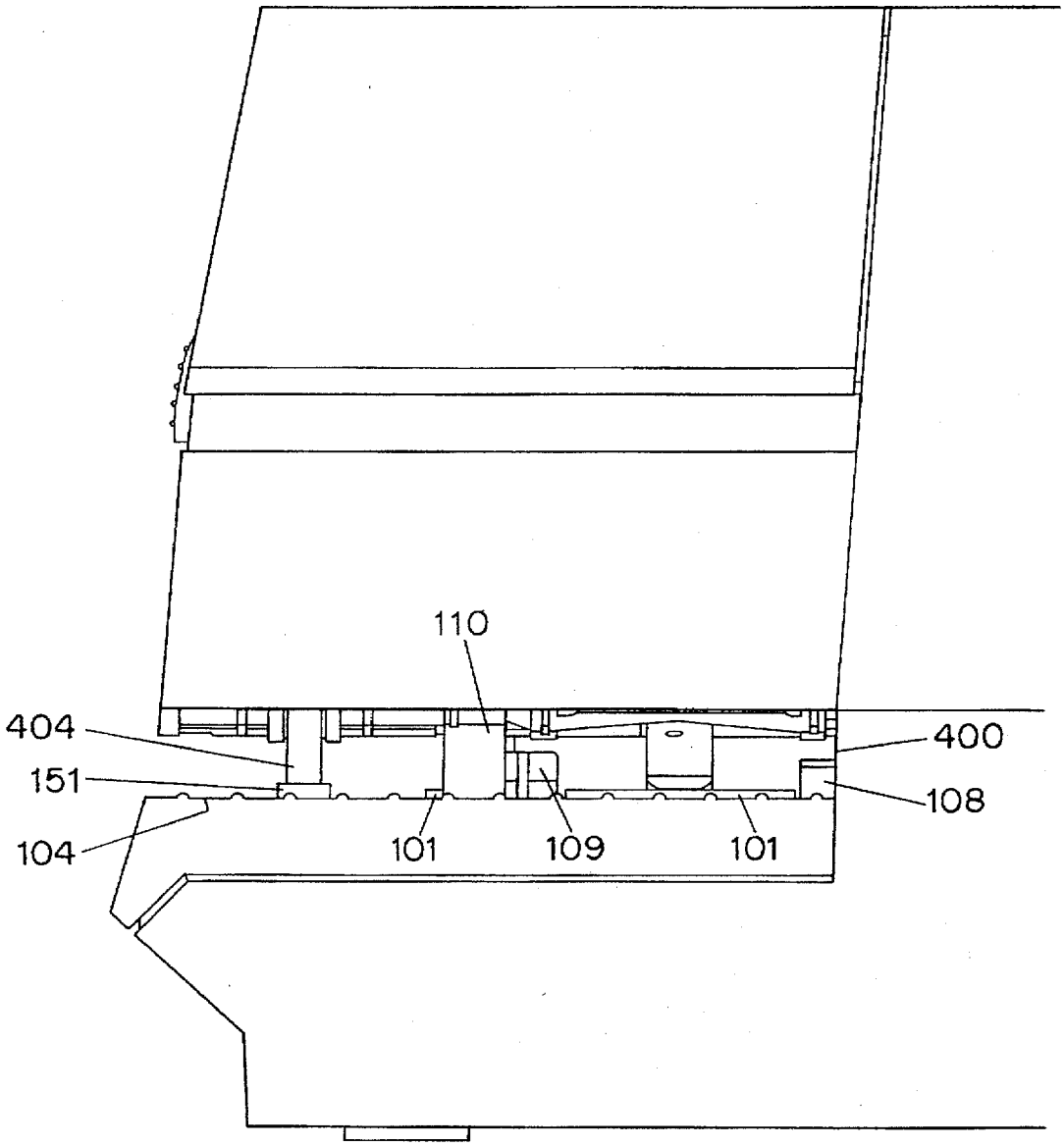
FIG. 15 shows the paper path from the point of view of the mail piece exit.

FIGS. 12, 13, and 14 show the assembly of the platen, carrier, and letter stopper in a side view, a perspective view, and a second perspective view, respectively. Turning first to FIG. 12, this shows a side view of the paper path, thus corresponding to FIGS. 3 and 16. Cam follower 141 is distant in the page, next closer is the trigger 115, a small portion of which is visible in front of the cam follower 141. Still closer is the letter stopper 132, a small portion of which is also visible in front of the cam follower 141. Platen 101 is also visible. Ejection roller 151 is in plain view, actuated by a gear train including gear 152 which engages a gear on the rotor, omitted for clarity in FIG. 12, but shown in FIGS. 13 and 14. Shaft 140 is urged leftwards by spring 148, the letter stopper 132 is urged counterclockwise by spring 149, and the trigger 115 is urged counterclockwise by spring 150. When the meter is in the home position (i.e. franking is not taking place) the trigger and stopper are both in the paper path, and the platen is not.

When a mail piece enters the meter, it deflects the trigger 115 clockwise. This raises the blade 114 and turns on the franking motor to commence rotation of the print rotor. As the rotor leaves its home position, cam follower 141 is permitted to rise. Spring 148 pulls the shaft 140 rightwards, thereby rotating the carrier 122 clockwise and lifting the platen 101 up to ride on the lower surface of the mail piece. Carrier 122 also forces the stopper 132 to rotate clockwise, thus pulling it down and below the paper path. The mail piece, gripped between the rotor and platen 101, is drawn to the right in FIG. 12. Gear 152 is driven clockwise by the rotor gear, and the shaft of the ejection roller 151 is likewise driven clockwise. The mail piece moves at fixed speed as driven by the rotor 100. Because the ejection roller moves no faster than the mail piece (during the time that it is in contact with the mail piece), energy is stored in a spring wrapped around the shaft of the ejection roller 151.

Ejection of the mail piece can happen in either of two ways.

First, if the mail piece is short in comparison to the circumference of the rotor, then the trailing edge of the mail piece is released from the rotor and platen 101, and the stored energy in the ejection roller spring causes a speedy ejection of the mail piece as the roller 151 spins quickly.

Second, if the rotor completes its cycle and returns to the home position, then the mail piece may still lie between the rotor and platen. As described above, however, the cam forces the cam follower 141 downward, thereby lowering the platen 101. This releases the mail piece, and the stored energy in the ejection roller spring causes a speedy ejection of the mail piece as the roller 151 spins quickly.

FIG. 13 shows the assembly of FIG. 12 in a perspective view. The gear train including gear 152 is visible. The position of the letter stopper 132 relative to the two portions of the platen is clear. Trigger portion 108 may be seen. When wall 400 (FIG. 4) is present, it conceals the rest of the trigger 115 and conceals the cam follower 141 and gear train including gear 152.

FIG. 14 shows the assembly of FIG. 12 in a second perspective view. The spring 148 which urges shaft 140 rightwards is visible. The cam follower member 142 and knee link may be seen. When member 142 is pushed downwards by the rotor cam in the home position, then the knee link forces the shaft 140 leftwards in FIG. 14.

FIG. 15 shows the paper path from the point of view of the mail piece exit. Detection lever 110 is prominent, as are ejection roller 151 and ejection idler 404. The bottom and side of the paper path are defined by horizontal surface 104 and wall 400. It will be appreciated that preferably the detection lever 110 is at least 2 centimeters from the wall 400 so that it will detect letters but not labels. Also preferably the position of the letter detector 110 is selected so that its point of contact with a mail piece is out of the path of the printed surface, so as to minimize the possibility of smudging the ink impression of postage value.

FIG. 16 shows the paper path in an expanded side view, including a subchassis 158 shown in phantom. Subchassis 158 carries the letter detector 110 and ejection idler 404. It will be appreciated that access to the detection lever 110 is denied by the ejection roller and the idler.

Figure 17:
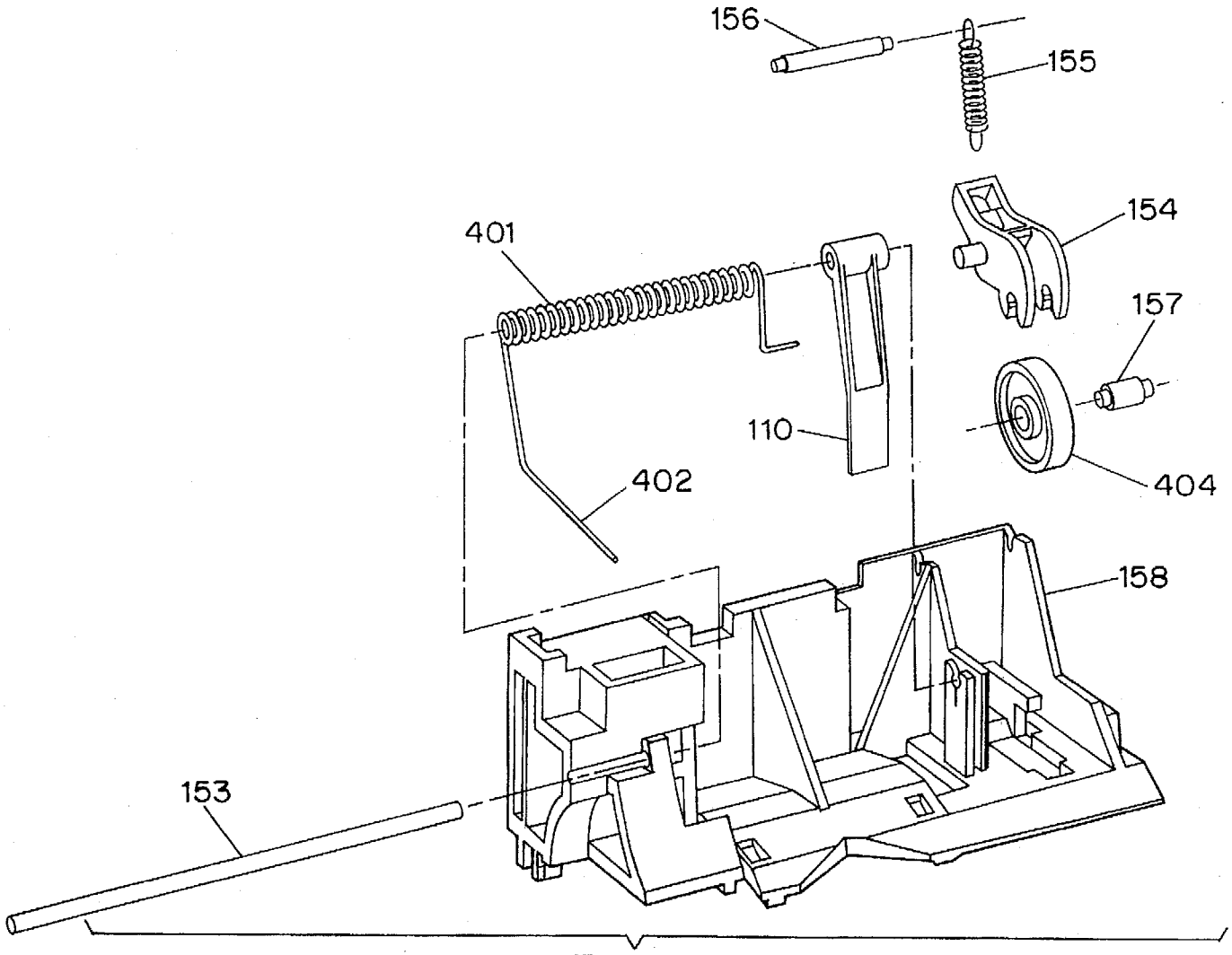
FIGS. 17 and 18 show the subchassis of FIG. 16 in exploded and perspective views, respectively.
Figure 18:
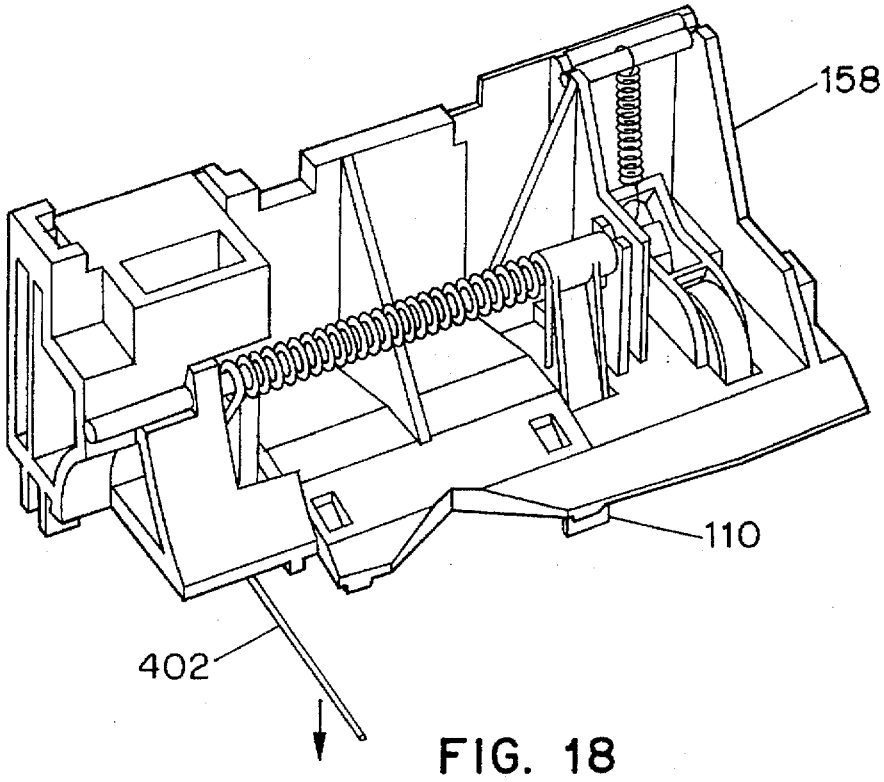

FIGS. 17 and 18 show the subchassis 158 of FIG. 16 in exploded and perspective views, respectively. Detection lever 110 pivots on shaft 153, urged against the paper path (out of the page in FIG. 17) by spring 401. The other end 402 of the spring 151 extends from the subchassis 158 and engages the trigger 115 as will be described in more detail below. Also visible in FIG. 17 is ejection idler 404, which is held in carrier 154 on shaft 157 and is urged downwards by spring 155 which is held by shaft 156. Spring end 402 rests upon feature 116 (FIG. 7) of the trigger 115. When there is no mail piece in the paper path the detector lever 110 is in the position shown in FIG. 17, held gently there by the spring 401. As a letter passes along the paper path it deflects detection lever 110 (into the page in FIG. 17). Later the letter leaves the paper path and the detection lever 110 again drops down to its rest position. If, however, a letter happens to get held in place due to a paper jam, it may continuously deflect the detection lever 110. This transmits force via spring end 402 and tends to continuously activate trigger 115. As a result, efforts to dislodge the letter from the paper path are unlikely to cause unwanted extra printing cycles and the resulting loss of postage value.

Figure 19:
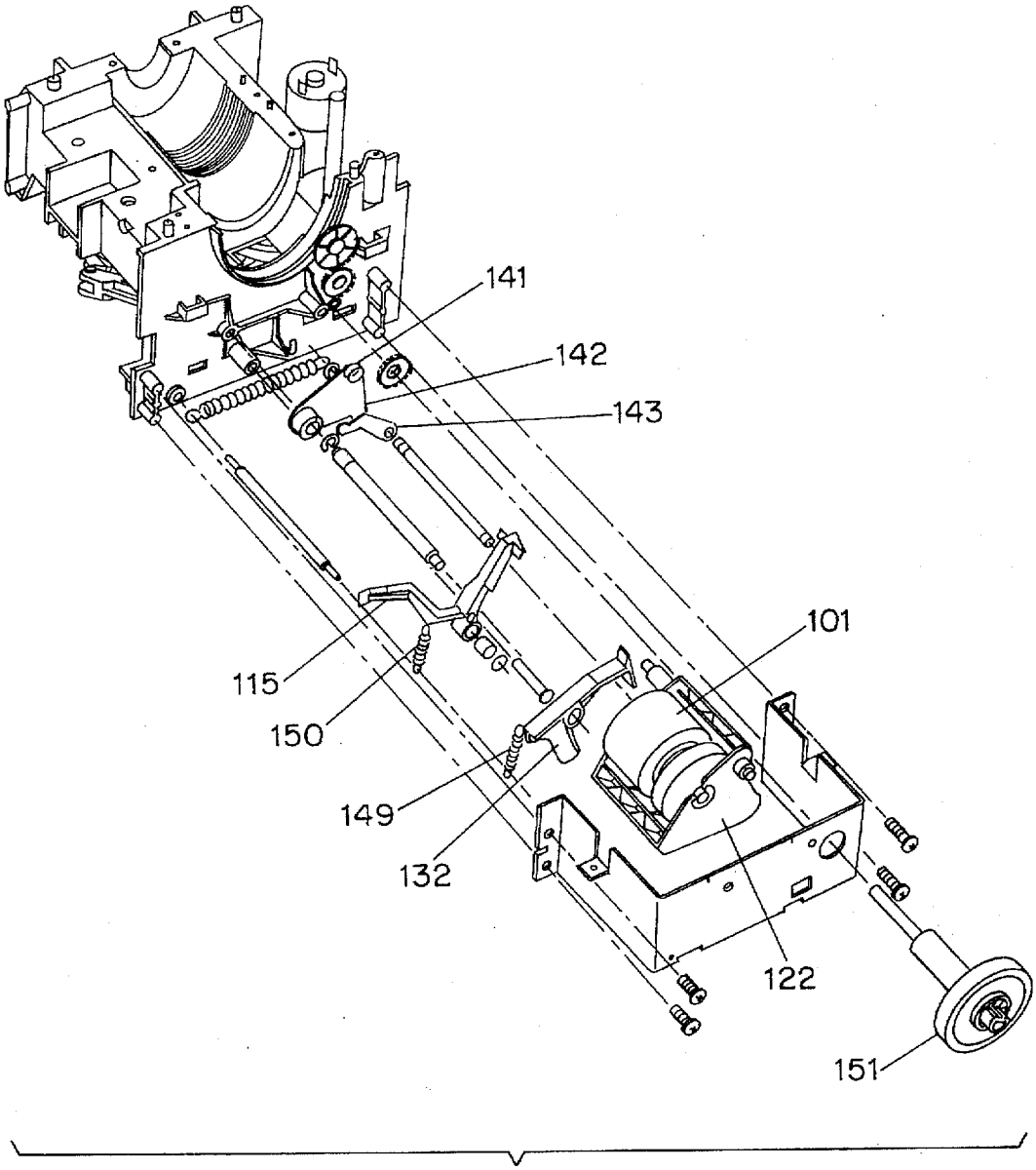
FIG. 19 shows the assembly of FIG. 12 in exploded view.

FIG. 19 shows the assembly of FIG. 12 in exploded view. Cam follower 141 is visible along with its lever 142 and the knee link 143. It will be appreciated that when the linkage is under pressure (i.e. when the rotor is in its home position) the only parts under pressure are metal parts. Plastic parts, including the platen carrier 122 and platen 101 and part of the rotor 100, are not under pressure. This eliminates a problem seen with many plastics, namely the tendency to change shape or to fatigue when subjected to pressure for long periods.

It will also be appreciated that the geometry of the lever 142 and link 143 may be (and preferably are) selected so that when the cam follower is deflected to its maximum downward extent (when the rotor is in its home position) the pressure on the cam is not very great because the three pivot points 191, 196, and 140 are nearly lined up.

Figure 21:
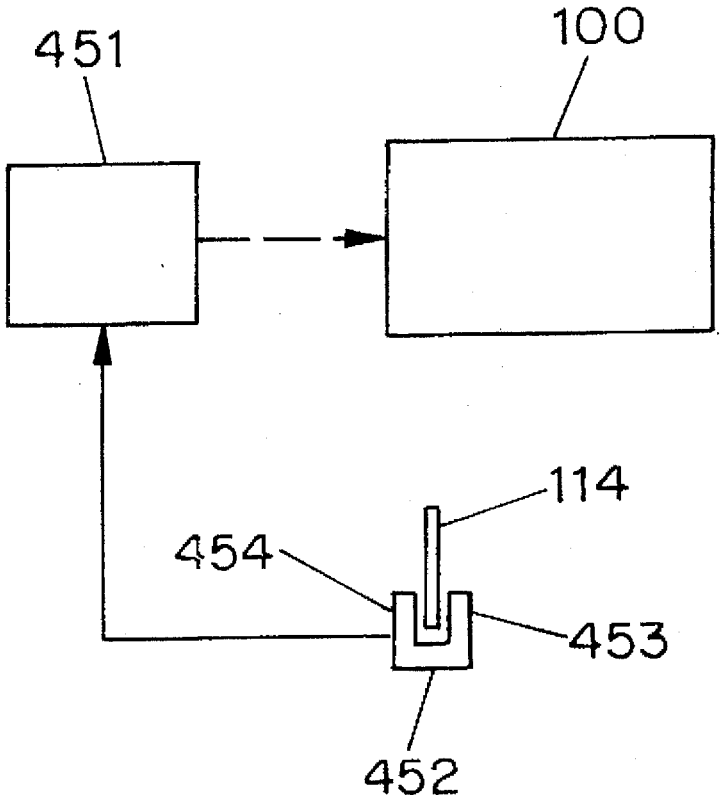
FIG. 21 is a functional block diagram showing operative connections between motor, rotor, and switch.

FIG. 21 shows the operative relationship between various parts of the meter. Motor 451 is operatively connected with the rotor 100. Switch 452 controls the motor 451, and is preferably composed of light source 453 and light sensor 454. It is noted that in a preferred embodiment the rotor 100 is rotatable in only one direction. Switch 452 has an output indicative of the trigger 115 being out of the paper path.

While the invention has been shown with respect to a particular embodiment, this in no way limits the scope of the patent, which is defined by the claims below. Those skilled in the art will have no difficulty devising obvious modifications and variations which all fall within the invention as defined by the claims.

We claim:

1. A postage meter comprising a print rotor and a resilient platen both within a secure housing, said print rotor and platen rotatable about respective axes parallel to each other, said print rotor rotatable in only one direction, said print rotor having a home position. the print rotor and platen together defining a paper path, the direction of rotation of the print rotor defining a downstream direction of the paper path, the print rotor further comprising a radial cam, the meter further comprising a cam follower positioned within the secure housing in engagement with the cam, said platen held by a carrier movable toward and away from said print rotor, the carrier mechanically linked to the cam follower such that when the cam follower is in a first position the carrier is moved away from the print rotor and when the cam follower is in a second position the carrier is urged toward the print rotor, the cam shaped so that when the print rotor is in its home position the cam follower is in said first position and when the print rotor is away from its home position the cam follower is in its second position, the postage meter further comprising a letter stopper pivoted within the secure housing and rotatable between a first position, in which the letter stopper impedes motion along the paper path at a point downstream of the plane containing the print rotor and platen axes, and a second position in which the letter stopper is out of the paper path, said letter stopper urged toward said first position, said letter stopper mechanically linked with the carrier such that when the carrier is moved toward the print rotor the letter stopper is moved into its second position.

2. The postage meter of claim 1 wherein the carrier is urged toward the print rotor by a spring.

3. The postage meter of claim 1 in which the cam follower is further characterized in that its first position is away from the print rotor and its second position is toward the print rotor, and the portion of the radial cam in contact with the cam follower when the print rotor is in its home position is of larger radius than the rest of the cam.

4. The postage meter of claim 1 wherein the letter stopper is urged toward its first position by a spring.

5. The postage meter of claim 4 wherein the platen is in two coaxial portions and the letter stopper is positioned between the portions.

6. The postage meter of claim 1 further characterized in that when the cam follower is said first position, the spacing between the platen and the print rotor is between 3 and 8 millimeters.

7. The postage meter of claim 6 further characterized in that when the cam follower is said first position, the spacing between the platen and the print rotor is between 5 and 7 millimeters.

8. The postage meter of claim 1 further comprising a trigger and a motor, the motor operatively coupled with the print rotor to cause rotation thereof, the trigger rotating on a pivot within the secure housing and rotatable between a first position in which a portion of the trigger is within the paper path and a second position in which the trigger is out of the paper path, said trigger operatively coupled with a switch having an output indicative of the trigger being out of the paper path, the switch output operatively coupled with the motor to actuate the motor.

9. The postage meter of claim 8 wherein the portion of the trigger within the paper path is downstream of the plane containing the axes of the print rotor and platen.

10. The postage meter of claim 8 in which a portion of the secure housing defines a guide wall perpendicular to the axis of the print rotor, the trigger disposed between the platen and the guide wall.

11. The postage meter of claim 8 further comprising a detection lever pivoted within the secure housing and rotatable between a first position in which a portion of the detection lever lies within the paper path downstream of the print rotor and platen and a second position in which the detection lever is substantially out of the paper path, said detection lever urged into the first position by a first spring means; said detection lever coupled by a second spring means with the trigger such that when the detection lever is in its second position the trigger is urged toward its second position.

12. The postage meter of claim 1 further comprising a trigger and a motor, the motor operatively coupled with the print rotor to cause rotation thereof, the trigger pivoted within the secure housing and rotatable between a first position in which a portion of the trigger is within the paper path and a second position in which the trigger is out of the paper path, said trigger operatively coupled with a switch having an output indicative of the trigger being out of the paper path, the switch output operatively coupled with the motor to actuate the motor, and wherein the portion of the trigger within the paper path is downstream of the plane containing the axes of the print rotor and platen.

13. The postage meter of claim 11 wherein the first and second spring means comprise a single spring.

14. The postage meter of claim 11 in which a portion of the secure housing defines a guide wall perpendicular to the axis of the print rotor, wherein the portion of the detection lever lying within the paper path is distanced at least two centimeters from the wall.

15. The postage meter of claim 8 in which the trigger further comprises an elongate blade member disposed about a region between a light source and light sensor, the distance from the region to the pivot being greater than the distance from the pivot to the portion of the trigger within the paper path.

16. The postage meter of claim 8 in which the trigger further comprises a free-moving mass within an enclosure, the enclosure shaped to constrain the mass from movement radial to the pivot and to constrain the mass from movement axial to the pivot, the postage meter further comprising a spring urging the trigger into its first position.

17. The postage meter of claim 8 wherein the trigger is balanced to have a minimal net moment about its pivot.

18. The postage meter of claim 16 wherein the trigger is balanced to have a minimal net moment about its pivot.

19. The postage meter of claim 16 wherein the mass and enclosure shape are selected to damp movement of the trigger during movement thereof from the second position to the first position.

20. A postage meter comprising a print rotor and a resilient platen both within a secure housing, said print rotor and platen rotatable about respective axes parallel to each other, said print rotor rotatable in only one direction, said print rotor having a home position, the print rotor and platen together defining a paper path, the direction of rotation of the print rotor defining a downstream direction of the paper path, the meter further comprising a trigger and a motor, the motor operatively coupled with the print rotor to cause rotation thereof, the trigger rotating about a pivot within the secure housing and rotatable between a first position in which a portion of the trigger is within the paper path and a second position in which the trigger is out of the paper path, said trigger operatively coupled with a switch having an output indicative of the trigger being out of the paper path, the switch output operatively coupled with the motor to actuate the motor, the trigger further comprising a free-moving mass within an enclosure within the trigger, the enclosure shaped to constrain the mass from movement radial to the pivot and to constrain the mass from movement axial to the pivot, the postage meter further comprising a spring urging the trigger into its first position.

21. The postage meter of claim 20 wherein the portion of the trigger lying within the paper path is downstream of the plane containing the axes of the print rotor and platen.

22. The postage meter of claim 20 in which a portion of the secure housing defines a guide wall perpendicular to the axis of the print rotor, the trigger disposed between the platen and the guide wall.

23. The postage meter of claim 20 further comprising a detection lever pivoted within the secure housing and rotatable between a first position in which a portion of the detection lever lies within the paper path downstream of the print rotor and platen and a second position in which the detection lever is substantially out of the paper path, said detection lever urged into the first position by a first spring means; said detection lever coupled by a second spring means with the trigger such that when the detection lever is in its second position the trigger is urged toward its second position.

24. The postage meter of claim 21 further comprising a detection lever pivoted within the secure housing and rotatable between a first position in which a portion of the detection lever lies within the paper path downstream of the portion of the trigger lying within the paper path and a second position in which the detection lever is substantially out of the paper path, said detection lever urged into the first position by a first spring means; said detection lever coupled by a second spring means with the trigger such that when the detection lever is in its second position the trigger is urged toward its second position.

25. The postage meter of claim 23 wherein the first and second spring means comprise a single spring.

26. The postage meter of claim 23 in which a portion of the secure housing defines a guide wall perpendicular to the axis of the print rotor, wherein the portion of the detection lever lying within the paper path is distanced at least two centimeters from the wall.

27. The postage meter of claim 20 in which the trigger further comprises an elongate blade member disposed about a region between a light source and light sensor, the distance from the region to the pivot being greater than the distance from the pivot to the portion of the trigger within the paper path.

28. The postage meter of claim 20 wherein the trigger is balanced to have a minimal net moment about its pivot.

29. The postage meter of claim 20 wherein the mass and enclosure shape are selected to damp movement of the trigger during movement thereof from the second position to the first position.

30. The postage meter of claim 20 in which the print rotor further comprises a radial cam, the meter further comprising a cam follower positioned within the secure housing in engagement with the cam, said platen held by a carrier movable toward and away from said print rotor, the carrier mechanically linked to the cam follower such that when the cam follower is in a first position the carrier is moved away from the print rotor and when the cam follower is in a second position the carrier is urged toward the print rotor, the cam shaped so that when the print rotor is in its home position the cam follower is said first position and when the print rotor is away from its home position the cam follower is in its second position.

31. The postage meter of claim 30 wherein the carrier is urged toward the print rotor by a spring.

32. The postage meter of claim 30 in which the cam follower is further characterized in that its first position is away from the print rotor and its second position is toward the print rotor, and the portion of the radial cam in contact with the cam follower when the print rotor is in its home position is of larger radius than the rest of the cam.

33. The postage meter of claim 30 further comprising a letter stopper pivoted within the secure housing and rotatable between a first position in which the letter stopper impedes motion along the paper path and a second position in which the letter stopper is out of the paper path, said letter stopper urged toward said first position, said letter stopper mechanically linked with the carrier such that when the carrier is moved toward the print rotor the letter stopper is moved into its second position.

34. The postage meter of claim 33 wherein the letter stopper is urged toward its first position by a spring.

35. The postage meter of claim 34 wherein the platen is in two coaxial portions and the letter stopper is positioned between the portions.

36. The postage meter of claim 30 further characterized in that when the cam follower is said first position, the spacing between the platen and the print rotor is between 3 and 8 millimeters.

37. The postage meter of claim 36 further characterized in that when the cam follower is said first position, the spacing between the platen and the print rotor is between 5 and 7 millimeters.

38. The postage meter of claim 33 wherein the location at which the letter stopper impedes motion along the paper path is downstream of the plane containing the axes of the print rotor and platen.

39. The postage meter of claim 33 wherein the location at which the letter stopper impedes motion along the paper path is downstream of the portion of the trigger lying within the paper path.

40. The postage meter of claim 39 wherein the portion of the trigger lying within the paper path is downstream of the plane containing the axes of the print rotor and platen.

41. A postage meter comprising a print rotor and a resilient platen, said print rotor and platen rotatable about respective axes parallel to each other, said print rotor rotatable in only one direction, said print rotor having a home position, the print rotor and platen together defining a paper path, the direction of rotation of the print rotor defining a downstream direction of the paper path, the meter further comprising a trigger and a motor, the motor operatively coupled with the print rotor to cause rotation thereof, the trigger rotating about a pivot within the secure housing and rotatable between a first position in which a portion of the trigger is within the paper path and a second position in which the trigger is out of the paper path, said trigger operatively coupled with a switch having an output indicative of the trigger being out of the paper path, the switch output operatively coupled with the motor to actuate the motor, the postage meter further comprising a detection lever pivoted within the secure housing and rotatable between a first position in which a portion of the detection lever lies within the paper path downstream of the print rotor and platen and a second position in which the detection lever is substantially out of the paper path, said detection lever urged into the first position by a first spring means; said detection lever coupled by a second spring means with the trigger such that when the detection lever is in its second position the trigger is urged toward its second position.

42. The postage meter of claim 41 wherein the portion of the trigger lying within the paper path is downstream of the plane containing the axes of the print rotor and platen, and the portion of the detection lever lying within the paper path is downstream of the portion of the trigger lying within the paper path.

43. The postage meter of claim 41 wherein the first and second spring means comprise a single spring.

44. The postage meter of claim 41 in which a portion of the secure housing defines a guide wall perpendicular to the axis of the print rotor, the trigger disposed between the platen and the guide wall.

45. The postage meter of claim 41 in which a portion of the secure housing defines a guide wall perpendicular to the axis of the print rotor, wherein the portion of the detection lever lying within the paper path is distanced at least two centimeters from the wall.

46. The postage meter of claim 41 in which the trigger further comprises an elongate blade member disposed about a region between a light source and light sensor, the distance from the region to the pivot being greater than the distance from the pivot to the portion of the trigger within the paper path.

47. The postage meter of claim 41 in which the trigger further comprises a free-moving mass within an enclosure, the enclosure shaped to constrain the mass from movement radial to the pivot and to constrain the mass from movement axial to the pivot, the postage meter further comprising a spring urging the trigger into its first position.

48. The postage meter of claim 41 wherein the trigger is balanced to have a minimal net moment about its pivot.

49. The postage meter of claim 47 wherein the trigger is balanced to have a minimal net moment about its pivot.

50. The postage meter of claim 47 wherein the mass and enclosure shape are selected to damp movement of the trigger during movement thereof from the second position to the first position.

51. The postage meter of claim 41 in which the print rotor further comprises a radial cam, the meter further comprising a cam follower positioned within the secure housing in engagement with the cam, said platen held by a carrier movable toward and away from said print rotor, the carrier mechanically linked to the cam follower such that when the cam follower is in a first position the carrier is moved away from the print rotor and when the cam follower is in a second position the carrier is urged toward the print rotor, the cam shaped so that when the print rotor is in its home position the cam follower is said first position and when the print rotor is away from its home position the cam follower is in its second position.

52. The postage meter of claim 51 wherein the carrier is urged toward the print rotor by a spring.

53. The postage meter of claim 51 in which the cam follower is further characterized in that its first position is away from the print rotor and its second position is toward the print rotor, and the portion of the radial cam in contact with the cam follower when the print rotor is in its home position is of larger radius than the rest of the cam.

54. The postage meter of claim 51 further comprising a letter stopper pivoted within the secure housing and rotatable between a first position in which the letter stopper impedes motion along the paper path and a second position in which the letter stopper is out of the paper path, said letter stopper urged toward said first position, said letter stopper mechanically linked with the carrier such that when the carrier is moved toward the print rotor the letter stopper is moved into its second position.

55. The postage meter of claim 54 wherein the letter stopper is urged toward its first position by a spring.

56. The postage meter of claim 51 wherein the platen is in two coaxial portions and the letter stopper is positioned between the portions.

57. The postage meter of claim 51 further characterized in that when the cam follower is said first position, the spacing between the platen and the print rotor is between 3 and 8 millimeters.

58. The postage meter of claim 57 further characterized in that when the cam follower is said first position, the spacing between the platen and the print rotor is between 5 and 7 millimeters.

59. The postage meter of claim 54 wherein the location at which the letter stopper impedes motion is downstream of the plane containing the axes of the print rotor and platen.

60. The postage meter of claim 54 wherein the portion of the trigger lying within the paper path is downstream of the plane containing the axes of the print rotor and platen, wherein the location at which the letter stopper impedes motion is downstream of the portion of the trigger lying within the paper path, and wherein the portion of the detection lever lying within the paper path is downstream of the location at which the letter stopper impedes motion.

* * * * *